United States Patent [19]

Burckhardt et al.

[11] Patent Number: 4,705,574

[45] Date of Patent: Nov. 10, 1987

[54] DEBONDING PROCESS FOR REMOVING NON-METALLIC COATINGS FROM METAL HANGERS

[75] Inventors: Klaus A. Burckhardt, Spring City; Howard D. Brodbeck, Berwyn, both of Pa.

[73] Assignee: MG Industries, Inc., Valley Forge, Pa.

[21] Appl. No.: 697,951

[22] Filed: Feb. 4, 1985

[51] Int. Cl.[4] ..... B08B 7/02

[52] U.S. Cl. ..... 134/17; 134/38; 62/24; 62/64; 62/373

[58] Field of Search ..... 62/24, 64, 373; 134/17, 134/38; 51/319

[56] References Cited

U.S. PATENT DOCUMENTS

| | | | |
|---|---|---|---|
| 3,337,815 | 9/1974 | Bixby | 134/17 |
| 3,934,379 | 1/1976 | Braton et al. | 51/319 |
| 3,948,679 | 4/1976 | Lewis | 134/17 |
| 4,205,530 | 6/1980 | Soecknick et al. | 62/64 |

*Primary Examiner*—Andrew Metz
*Assistant Examiner*—Sharon T. Cohen
*Attorney, Agent, or Firm*—John F. A. Earley; John F. A. Earley, III

[57] ABSTRACT

A process for removing layers of paint or other non-metallic coatings from a coated metal hanger or the like comprising the steps of freezing the coating to embrittle it and shrink it toward the metal hanger, heating the metal hanger without heating the coating to expand the metal toward the coating, and stressing the coating by said expanding and shrinking to break and fragment the coating and cause it to fall off the metal hanger.

5 Claims, No Drawings

DEBONDING PROCESS FOR REMOVING NON-METALLIC COATINGS FROM METAL HANGERS

BACKGROUND OF THE INVENTION

Field of the Invention

This invention relates to the field of removing non-metallic coatings from metal objects, and more particularly, it concerns removing layers of paint from coated metal hangers.

In many manufacturing operations, a newly made part or product is spray painted either with paint particles in a solvent, or with electrostatic powder coatings, and this occurs in many fields including automobile, appliance, metal furniture, tractors, and so on. In many cases, the parts are sprayed while being conveyed along a production line while the parts are suspended from metal hangers spaced along a conveyor system that carries the parts through a spraying station. As time goes on, these metallic hangers become covered with layer upon layer of paint and in time they become unusable. For example, they may become so coated that they won't conduct electricity to maintain an electrostatic charge.

Accordingly, it becomes a problem to remove the accumulated layers of paint from the metal hangers and restore the hangers to service. One solution has been proposed that uses solvents to dissolve the paint layers from the metal hanger. Another solution proposes burning off the non-metallic coatings. Another proposes impacting the coated hanger after embrittling the non-metallic coating by subjecting the coated hanger to extremely low temperatures, and also debonding the coating from the metal hanger by causing the coatings and the metal to contract at different rates to draw the faster-contracting metal away from the slower-contracting coatings.

U.S. Pat. No. 3,934,379 discloses a method for removing layers of organic material built up on a support for articles during surface finishing which includes the steps of rapidly reducing the temperature of a coated metal support, or of the coatings, to lessen the bonded relation between the coating layers and the support, to embrittle the coating, and to remove the coating by impacting the coating while it is still in a refrigerated state.

U.S. Pat. No. 4,205,530 discloses an apparatus and method for removing hard rubber tires from metal wheels by freezing and shrinking the rim of the wheel without freezing or shrinking the rubber tire to thereby pull the metal rim away from the tire so that the hard rubber tire can be removed easily without subjecting it to impact stress.

SUMMARY OF THE INVENTION

It is an object of the present invention to remove non-metallic coatings from metal objects, and more specifically to remove layers of paint from supports such as metal hangers.

It is another object to remove the coatings quickly and easily and without impacting the coated hangers and without damaging them.

The objects of this invention are accomplished by subjecting the coated hangers to a freezing step to shrink and embrittle the coatings, and by subjecting the metal to a heating step as by heating the metal with an induction coil to expand the metal into the shrinking coating, thereby subjecting the embrittled shrinking coating to stress from the expanding metal to shatter, fragment, and remove the coating from the metal hanger.

DETAILED DESCRIPTION OF THE INVENTION

In accordance with the invention, a carbon steel or stainless steel paint hanger coated with layers of paint is immersed in a tub of low temperature fluid such as liquid nitrogen or the like for a period of time until the coating reaches a temperature below the embrittlement temperature of the coating. The coated hanger is held in the freezing fluid to shrink the coating and to embrittle it.

The coated hanger is also subjected to a high inductive electrical field from an induction coil positioned around the tub to heat the metal of the coated hanger without heating the coating. This expands the metal into the shrinking, embrittled coating.

The freezing and heating steps are continued until a significant temperature difference is attained between the metal and the non-metal coating, whereupon the stress on the coating caused by the expanding metal and the shrinking and embrittled coating causes the coating to shatter, fragment, and fall off the metal hanger.

The process is more fully described in the following examples.

EXAMPLE 1

A metal hanger coated with layers of paint is subjected to a process for removing the paint layers from the metal hanger, which comprises the steps of freezing the coated metal hanger by dipping it into a bath of liquid nitrogen at its saturation temperature and holding it in the bath to shrink both the metal and the coating. Because the metal and the paint have different coefficients of expansion and contraction, the metal shrinks faster and shrinks more than the coating, and this differential shrinking loosens the bond between the inner surface of the coating and the outer surface of the metal and opens a gap between them. The metal is then heated without heating the coating to expand the metal towards the shrinking coating. This is accomplished by heating the metal with an electrical induction coil. The expanding metal stresses the cold coating, and this stress causes the coating to break, fragment, and fall off the hanger. The coating is removed from the hanger without the necessity of impacting the coating.

EXAMPLE 2

A metal hanger coated with layers of paint is subjected to a process for removing the coating which includes the steps of simultaneously freezing the coating and heating the metal. This is done by dipping the coated hanger into a bath of liquid nitrogen to freeze the coating, and by simultaneously heating the metal of the hanger with an induction coil that heats the metal without heating the coating. This freezing and contracting of the coating, and simultaneous heating and expanding of the metal, stresses and embrittles the coating, and the stress breaks and fragments the coating so that it falls off the metal hanger.

EXAMPLE 3

A coated metal hanger is subjected to a process for removing the coating by heating the metal with an induction coil to expand the metal into the coating. Then the coated hanger is subjected to liquid nitrogen at its saturation temperature by dipping it into a bath of liquid nitrogen to shrink and embrittle the coating against the expanding metal which stresses the coating to break and shatter it, and cause it to fall away from the metal hanger.

The process of this invention is cost-effective, pollution-free, and provides for the efficient recycling of metal parts and removal of unwanted non-metallic coatings which attach themselves to hangers through manufacturing error, or attached themselves to parts during the course of a manufacturing process such as spray painting.

The inventive process is advantageous because it is not polluting and does not damage the metal in any way.

The inventive process may be applied to metal hangers, metal frames or other supports which become coated with plastics, polymers, or paints.

Preferably, the temperature of the metal should be increased and the temperature of the coating should be decreased to give a difference in temperature of 200° to 300° F. or more.

The invention produces a clean metal hanger, and also separates out the coating material which may be recycled.

We claim:

1. A process for removing layers of paint or other non-metallic coatings from a coated metal hanger comprising the steps of freezing the coating to embrittle the coating and shrink the coating toward the metal hanger, heating the metal hanger by electrical means which heats the metal to expand the metal toward the coating, and said freezing and heating stressing the coating by said expanding and shrinking to break and fragment the coating and cause the coating to fall off the metal hanger.

2. The process of claim 1, wherein the freezing and heating steps are performed simultaneously.

3. The process of claim 1, wherein the heating step is performed prior to the freezing step to expand the metal into the coating, and the freezing step is performed after the heating step to shrink and embrittle the coating against the expanding metal to stress the coating and break and shatter the coating, and cause the coating to fall away from the metal hanger.

4. The process of claim 1, wherein the heating step is performed by subjecting the coated hanger to an induction coil to heat the metal without heating the coating, thereby expanding the metal without expanding the coating.

5. A process for removing layers of paint or other non-metallic coatings from a coated metal hanger comprising the steps of freezing the coated metal hanger to shrink the metal and the coating, shrinking the metal more and faster than the coating to loosen the bond between the metal and the coating and open a gap between the metal and the coating, heating the metal hanger by electrical means which heats the metal to expand the metal towards the coating, and said freezing and heating stressing the cold coating by expanding hot metal to break and fragment the coating, and cause the coating to fall from the hanger.

* * * * *